US006740480B1

(12) United States Patent
Aylward et al.

(10) Patent No.: US 6,740,480 B1
(45) **Date of Patent: *May 25, 2004**

(54) FINGERPRINT PROTECTION FOR CLEAR PHOTOGRAPHIC SHIELD

(75) Inventors: Peter T. Aylward, Hilton, NY (US); Alphonse D. Camp, Rochester, NY (US); Robert P. Bourdelais, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/705,545

(22) Filed: Nov. 3, 2000

(51) Int. Cl.[7] ..... G03C 1/765; G03C 3/00; G03C 1/795; G03C 11/14

(52) U.S. Cl. ..... 430/496; 430/403; 430/432; 430/510; 430/523; 430/527; 430/530; 430/531; 430/533; 430/536; 430/11

(58) Field of Search ..... 430/11, 403, 432, 430/496, 510, 523, 527, 530, 531, 533, 536

(56) References Cited

U.S. PATENT DOCUMENTS

| | | | | | |
|---|---|---|---|---|---|
| 2,732,305 | A | * | 1/1956 | Richman et al. | 430/514 |
| 3,397,980 | A | | 8/1968 | Stone | |
| 3,697,277 | A | | 10/1972 | King | |
| 4,047,958 | A | | 9/1977 | Yoneyama et al. | 430/531 |
| 4,078,935 | A | | 3/1978 | Nakagiri et al. | |
| 4,355,099 | A | | 10/1982 | Trautweiler | 430/531 |
| 4,612,279 | A | | 9/1986 | Steklenski et al. | 430/523 |
| 5,225,319 | A | * | 7/1993 | Fukazawa et al. | 430/533 |
| 5,244,861 | A | | 9/1993 | Campbell et al. | |
| 5,424,175 | A | * | 6/1995 | Ueda et al. | 430/533 |
| 5,541,048 | A | | 7/1996 | Whitesides et al. | 430/523 |
| 5,679,505 | A | * | 10/1997 | Tingler et al. | 430/527 |
| 5,695,919 | A | | 12/1997 | Wang et al. | 430/527 |
| 5,738,983 | A | | 4/1998 | Smith et al. | |
| 5,756,273 | A | | 5/1998 | Wang et al. | |
| 5,776,668 | A | * | 7/1998 | Oltean et al. | 430/496 |
| 5,807,661 | A | * | 9/1998 | Coltrain et al. | 430/496 |
| 5,817,451 | A | * | 10/1998 | Nair et al. | 430/496 |
| 5,866,282 | A | | 2/1999 | Bourdelais et al. | 430/536 |
| 5,905,021 | A | | 5/1999 | Anderson et al. | |
| 5,914,220 | A | * | 6/1999 | Murayama et al. | 430/496 |
| 5,965,339 | A | | 10/1999 | Smith et al. | |
| 6,043,014 | A | | 3/2000 | Tingler et al. | 430/527 |
| 6,060,226 | A | * | 5/2000 | Hashimoto | 430/496 |
| 6,077,648 | A | | 6/2000 | Nair et al. | |
| 6,080,532 | A | | 6/2000 | Camp et al. | |
| 6,153,368 | A | | 11/2000 | Schwark et al. | 430/527 |
| 6,165,792 | A | | 12/2000 | Allen et al. | 430/537 |
| 6,207,361 | B1 | * | 3/2001 | Greener et al. | 430/536 |
| 6,277,547 | B1 | * | 8/2001 | Bourdelais et al. | 430/536 |
| 6,326,109 | B1 | * | 12/2001 | Bourdelais et al. | 430/496 |
| 6,344,310 | B1 | * | 2/2002 | Bourdelais et al. | 430/536 |
| 6,465,164 | B1 | * | 10/2002 | Aylward et al. | 430/536 |

FOREIGN PATENT DOCUMENTS

| | | | |
|---|---|---|---|
| EP | 0 829 760 | | 3/1998 |
| EP | 100 3073 | * | 5/2000 |

* cited by examiner

*Primary Examiner*—Richard L. Schilling
(74) *Attorney, Agent, or Firm*—Paul A. Leipold

(57) ABSTRACT

The invention provides a photographic element comprising a transparent polymer sheet, at least one layer containing negative working photosensitive silver halide and at least one upper protective shield to protect the surface of said transparent polymer.

16 Claims, No Drawings

FINGERPRINT PROTECTION FOR CLEAR PHOTOGRAPHIC SHIELD

FIELD OF THE INVENTION

This invention relates to photographic materials. It particularly relates to photographic base materials containing a clear protective shield for optical and digitally compatible silver halide imaging layers.

BACKGROUND OF THE INVENTION

In the formation of photographic paper it is known that a white pigmented layer is placed directly under the photosensitive silver halide emulsion. The white pigmented layer is typically a polymer such as polyethylene or polyester in which a white pigment such as $TiO_2$ is dispersed. Such a layer is highly reflective and opaque and enhances the image sharpness of the exposed and developed image. Furthermore, it is known in the art that as the concentration and amount of $TiO_2$ in the reflective layer under the emulsion is increased, the image sharpness is increased. Sharp images are highly desirable and have significant commercial value.

It has been proposed in U.S. Pat. No. 5,244,861 to utilize biaxially oriented polypropylene sheets laminated to cellulose photographic paper for use as a reflective receiver for the thermal dye transfer imaging process. In the formation of biaxially oriented sheets described in U.S. Pat. No. 5,244,861, a coextruded layer of polypropylene is cast against a water-cooled roller and quenched by either immersion in a water bath or by cooling the melt by circulating chill liquid internal to the chill roll. The sheet is then oriented in the machine direction and in the transverse direction. The biaxial orientation process creates a sheet that has a highly pigmented layer on the topside of a voided layer. The pigmented layer provides a highly reflective layer immediately under the image layer. There remains a need to create an image-sharpening layer that provides additional sharpness to a photosensitive silver halide layer without having to additional expensive white pigment such as $TiO^2$. While $TiO^2$ is highly reflective and desirable, it is very expensive and furthermore tends to scatter light in multiple directions, which tends to corrupt the purity of the photosensitive dyes.

In U.S. Pat. No. 5,866,282 it has been proposed to use biaxially oriented polyolefin sheets laminated to photographic grade paper as a photographic support for silver halide imaging systems. In U.S. Pat. No. 5,866,282 numerous advantages are obtained by the use of the high strength biaxially oriented polyolefin sheets. Advantages such as increased opacity, improved image tear resistance, and improved image curl are obtained. While all of these photographic improvements are possible with the use of biaxially oriented polyolefin sheets, the use of biaxially oriented sheets with solid surface skins for silver halide imaging systems is restricted to the amount of $TiO_2$ that can be dispersed in the polyolefin polymers, as well as to the practical limitation of the thickness of the pigmented and voided layers.

In reflective photographic papers there is a need to protect the imaging layers from scratches, fingerprints, and stains. Current photographic reflective papers use a gelatin overcoat to protect the imaging layers. While the gelatin does provide some level of protection, it can easily be scratched reducing the quality of the image. Further, fingerprints or stains caused by common household liquids such as coffee, water, or fruit juice can easily stain and distort images. Wiping the images while wet causes undesirable distortion to the gelatin overcoat. Post photographic processing equipment exists that provides a protective coating to the imaging layers. Typically consumer images are individually coated or laminated with a polymer to provide protection to the image layers. A common example is photographic identification badges, which are typically laminated with a clear polymer sheet to provide protection to the image on the identification badge. Post processing application of a protective layer is expensive, as it requires an additional step in the preparation of the reflective print and additional materials to provide the overcoat. It would be desirable if a reflective photographic image could be formed with a protective coating over the developed image layers that could be efficiently applied.

Typically, photographic reflective imaging layers are coated on a polyethylene coated cellulose paper. While polyethylene coated cellulose paper does provide an acceptable support for the imaging layers, there is a need for alternate support materials such as polyester or fabric. The problem with alternate, nonpaper supports is the lack of robustness in photographic processing equipment to mechanical property changes in supports. The photographic processing equipment will not run photographic materials that have significantly different mechanical properties than prior art photographic materials. It would be desirable if a reflective photographic image could be efficiently formed on alternate supports.

U.S. Pat. No. 4,355,099 is concerned with a clear polyethylene In terephthalate film of 20 micrometers that is coated with a silver bromide emulsion and emulsion protective layer. Exposure is through the clear film base. The material is processed and then glued to a white reflective support. While this patent offers some advantages over conventional photographic prints, the polyethylene terephthalate film is also subject to fingerprints, scratches, abrasions and provides little or no fade protection to the photographic dyes against ultraviolet radiation. Viewing of photographic prints subjects them to numerous abuses that can permanently damage a print that make it very unattractive displeasing to the viewer. There remains a need for a more durable photographic imaging element that is resistant to handling damage. Furthermore, U.S. Pat. No. 4,355,099 demonstrates a technique to provide texturing by calendering after the image has been glued to a substrate. One of the inherent problems of applying excessive pressure to an image is distortion of the image, as well as creating a differential thickness of the glue holding top image to the support. This differential thickness can cause problems with the appearance of the image as well as curl and adhesion. In the case where photosensitive silver halide is used, excessive pressure may result in undesired development site causing the picture not to be a true representation of what was captured. There remains a need to provide an improved means of creating a rough surface for a composite print adhered to a reflective backing.

PROBLEM TO BE SOLVED BY THE INVENTION

Photographic materials typically are prone to fingerprinting, scratches, and other handling abuses such as liquid spills. Gelatin used in photographic layers tends to pick up and retain fingerprint oils which render photographic prints objectionable. Fingerprints are particularly objectionable when prints are scanned. Digital artifacts are created when fingerprints are present and their digital removal requires extra work. There remains a need to provide improved photographic materials that are resistant to fingerprints and other abuses.

SUMMARY OF THE INVENTION

It is an object of the invention to improved photographic materials.

It is another object to provide photographic materials that are resistant to fingerprints.

It is a further object to provide photographic materials that are resistant to scratches.

It is an additional object to provide photographic prints that are resistant to liquids.

It is a further object to provide photographic elements that may be easily provided in finished form with a variety of substrates.

These and other objects of the invention are accomplished by a photographic element comprising a transparent polymer sheet, at least one layer containing negative working photosensitive silver halide and at least one upper protective shield to protect the surface of said transparent polymer.

ADVANTAGEOUS EFFECT OF THE INVENTION

The invention provides a photographic element that is highly resistant to handling damage such as fingerprinting, scratches, and liquid spill. Furthermore, the imaging material easily adheres to a variety of substrates.

DETAILED DESCRIPTION OF THE INVENTION

The invention has numerous advantages over prior practices in the art. The elements of the invention are lighter in weight and thickness so that a roll of the photographic element of the same diameter will contain many more linear feet resulting in many more images per roll. The imaging element of the invention after development may be easily adhered to a variety of substrates, thereby allowing customized use of the images. It may be desirable for images that are mailed to be adhered to a lightweight substrate, whereas images to be displayed can easily be adhered to a heavy substrate after their development. The invention further provides a wear resistant surface on the photographic element that will not be easily damaged during handling or use of the image. The wear resistant surface provides protection from fingerprinting, scratches, spills of liquids, and other environmental deleterious exposures. During the handling of a photographic material, such as coating, drying, finishing, winding, rewinding, printing, and viewing and handling by the final consumer, the material surfaces are often harmed by contact friction with other apparatus or with human handling and viewing. For example, scratches or abrasions can be brought about on the emulsion and backsides of conventional photographic materials. These scratches or abrasion marks are visible during printing or viewing. This causes serious problems in the practical use of the prints. Moreover, when the contact friction is high, the photographic materials do not transport smoothly during the manufacturing process or in various exposure and processing machines. These transport problems may result in product waste. In recent years, the conditions under which the photographic materials are manufactured or utilized have become more severe, because their applications have been extended (for example, in an atmosphere of high humidity and high temperature) or because the methods for their preparation have been advanced (for example, high speed curtain coatings, high speed finishing and cutting, and fast processing). Under these conditions, the photographic materials are more easily scratched. The substrate that is utilized in mounting of the photographic images of the invention may be lower in cost, as it is not present during development of the image and not subjected to the development chemicals. The problem of dusting during slitting and chopping of photographic elements is greatly minimized as slitting and chopping may take place when there is no paper substrate present. The paper substrate is the primary source of dusting during slitting and chopping operations. The photographic elements of the invention also are less susceptible to curl, as the gelatin containing layers are sealed from humidity contamination to a great degree. Further, the film provides a barrier to oxygen, as well as water vapor at the top of the print. Furthermore the top or uppermost surface of the film may further comprise a texture-imparting layer that is abrasion and fingerprint resistant. These and other advantages will be apparent from the detailed description below.

The terms as used herein, "top", "upper", and "face" mean the side or towards the side of an imaging member in which the print is viewed. The terms "bottom", "lower side", and "back" mean the side or towards the side bearing the imaging layers or developed image.

In one embodiment of this invention a photographic element comprises a transparent polymer sheet, at least one layer containing negative working photosensitive silver halide emulsion and at least one upper protective shield to protect the surface of the transparent polymer sheet. In the viewing format of this photographic element, the photosensitive emulsion is on the bottom most part of the polymer sheet and the protective shield is on the top most part of said photographic element. The upper protective shield, which is on top of the transparent polymer sheet, may have multiple functionality. The most desired functionality characteristics include antistatic protection, abrasion and scratch resistance and also fingerprint and stain resistance. These functional characteristics may be obtained in separate layers or all in one layer. In general abrasion resistances may be achieved by the use of tough, hard polymeric binders that may be further cross-linked to enhance toughness. The addition of lubricants may also help to abrasion and scratching by optimizing the sliding friction on the surface. In some cases the addition of matte or roughening particles also help to minimize the surface area which further helps to reduce the chance of scratching. The addition of conductive materials is also important to manage any electrostatic charge accumulation. This is important to assure good sliding and stacking of prints, and in the case of light sensitive materials, the management of static is critical to prevent unwanted electrostatic discharge that may cause unwanted light exposure of the light sensitive layers. Control of fingerprinting typically may be achieved by the selection of polymer and the inclusion of roughness via matte particles or immersible polymers.

There have been attempts over the years to provide protective layers for gelatin based photographic systems that will protect the images from damage by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009; 2,331,746, 2,798, 004, 3,113,867, 3,190,197, 3,415,670 and 3,733,293. The application of UV-polymerizable monomers and oligomers on processed image followed by radiation exposure to form cross-linked protective layer is described U.S. Pat. Nos. 4,092,173, 4,171,979, 4,333,998 and 4,426,431. Major drawbacks for the solvent coating method and the radiation cure method are the health and environmental concern of those chemicals to the coating operator and the instability and relatively short shelf life of the coating solutions. U.S. Pat. Nos. 3,397,980; 3,697,277 and 4,999,266 describe methods of laminating polymeric sheet film on the processed image as the protective layer. U.S. Pat. No. 2,706,686 describes a lacquer finish for photographic emulsions, with the aim of providing water and fingerprint resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent and, thus, is not compatible with current manufacturing of photographic products. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials and must be permeable to water in order to maintain processability. U.S. Pat. No. 5,179,147 likewise provides a layer that is not water-protective. There are numerous disadvantages to providing a protective overcoat directly over the image layer. The basic problem is being able to provide a material that is water permeable to allow development solutions to penetrate the gelatin emulsion layers, yet provide water holdout, abrasion resistance, and fingerprint resistances after development. Post process treatment of liquid materials onto a developed image requires extra drying or curing. Furthermore, it is difficult to get a uniform dried layer that is free of spots or streaks. This is very expensive and does not adequately correct the many handling issues that imaging product may encounter. By providing a transparent polymer sheet that is fully protected from abrasions, fingerprints, and other handling problems and the developed image side is then adhesively joined to a base sheet in a manner in which the image is protected on both sides, all of the handling problems are eliminated.

In the preferred embodiment of this invention the topmost part of the transparent polymer sheet further comprises an upper shield layer that protects said polymer sheet from fingerprints. Fingerprints contain oils that easily mark the viewing surface of photographic prints. Having fingerprint resistance in the outermost layer which is touched by the viewer is desirable to prevent damage to the prints, as well as to prevent unsightly fingerprints from interfering with the viewing pleasure of the print. In prior art practices, the photographic layers applied to the base substrate and contain gelatin. Gelatin can retain the fingerprint oils and leave unsightly marks that damage the print. Even when a transparent polymer sheet is used as the topmost layer to protect the photographic image, the highly smooth and glossy surface of the polymer sheet can easily retain fingerprint oils, making the prints unattractive. Attempts to remove the fingerprint oils can further result in scratches on the surface of the polymer sheet. This also is very undesirable and reduces the value of the print. In this invention one means to prevent fingerprints is to provide the transparent polymer sheet with an upper protective shield containing silica, low levels of pigment, polymeric beads, glass beads, or other materials to provide a roughness frequency that hides the formation of the fingerprint. A typical range of roughness to minimize fingerprint show-through is between 0.10 to 0.65 micrometers at a spatial frequency of between 0.03 and 6.35 millimeters. Some of the materials such as silica and some pigments may actually absorb fingerprint oils and prevent them from showing. These materials may be coated with binder materials such as latex or gelatin.

To provide abrasion and scratch resistance to the photographic element of the invention, it is desirable to use tough polymers, cross-linked polymer, improve the lubricity of the layers or even add matte particles to aid in the reduction of the coefficient of friction. In addition, it is desirable to provide at least one layer that is electrically conductive to prevent static buildup and discharge. It is desirable to use materials and amounts in any or all of these layers that optically are very clear and do not interfere with the exposure of the photosensitive layers when the exposure is made through the base. Furthermore, these materials should not interfere with the viewing of the final developed and processed photographic image. In this invention the light sensitive silver halide may be exposed from either the viewing side through the upper clear shield and transparent base in a right reading format or from the backside in a reverse reading format. Since the imaging member that includes a clear protective shield is substantially transparent, the exposure of the light sensitive silver halide may be made from either side. The preferred format is through the shield and the transparent polymer base. This method is preferred so an antihalation layer may be included on the same side as the light sensitive layer and as the bottommost layer. The antihalation layer helps to improve the sharpness of the image and prevents unwanted secondary exposure. In an additional embodiment of this invention the photographic element further comprises an antihalation layer. The antihalation layer may be either above the image layer and on the opposite uppermost side of the transparent sheet and upper shield or on the bottommost layer of the photographic emulsion. Placing the antihalation above the transparent sheet and the upper shield provides excellent scratch protection for the viewing side of the imaging element of this invention. In this case the antihalation should be in the most upper position because the antihalation materials need to be removed during processing. When the antihalation layer is above the image layer, the light sensitive layers are reversed exposed from the backside. In the preferred embodiment of this invention, the antihalation materials are below the outer bottommost layer of the light sensitive silver halide layers. This location is preferred because antihalation materials are easily removed during processing and can be applied at the same time as the light sensitive layers, thus avoiding another coating operation. In addition, the antihalation materials provide in the location a means to optimize the sharpness because of immediate proximity to the silver halide layer. Typical materials that are useful for antihalation are solid particle dyes and gray silver in a gelatin binder. The antihalation layer is typically a layer of gelatin with black or gray exposed silver. The purpose of such a layer is to provide improved sharpness and to prevent the reexposure of the silver grains once the light has passes through the emulsion. In a conventional photographic print in which the light sensitive emulsion is on top of the support, a considerable amount of light may be diffusely transmitted by the emulsion and strike the back surface of the support. This light is partially or totally reflected back to the emulsion and reexposed at a considerable distance from the initial point of entry. This effect is called halation because it causes the appearance of halos around images of bright objects. Further, a transparent support also may pipe light. Halation can be greatly reduced or eliminated by absorbing the light transmitted by the emulsion or piped by the support. Three methods of providing halation protection are (1) coating an antihalation undercoat which is either dye gelatin or gelatin containing gray silver on the bottommost layer of the imaging member, (2) coating the emulsion on a support that contains either dye or pigments, and (3) coating the emulsion on a transparent support that has a dye to pigment a layer coated on the top. The absorbing material contained in the antihalation is removed by processing chemicals when the photographic element is processed. The dye or pigment within the support is permanent and generally is not preferred for the instant invention. It is preferred that the antihalation layer be formed of gray silver which is coated on the bottommost side furthest from the viewer and removed during processing. By coating the antihalation on the bottommost part of the backside of the transparent polymer sheet, the antihalation layer is easily removed during processing, as well as allowing exposure of the material from only one side. It has also been found that small quantities of $TiO_2$ or white pigment added to the non-light sensitive layers such as the ultraviolet layer furthest from the transparent polymer sheet or size overcoat layer of a typical emulsion provide improved exposure speed and sharpness.

One embodiment of this invention comprises a transparent polymer sheet with a developed image, and an upper shield further comprises film-forming polymeric binder, lubricants, matte filler particles, or beads. In a preferred embodiment to minimizes scratches and/or fingerprints, said upper shield layer comprises lubricants, film-forming polymeric binder, and matte filler particles wherein said lubricant may be selected from the group consisting of silicates, silicone based materials, fatty acids, fatty acid derivatives, alcohols, alcohol derivatives, fatty acid esters, fatty acid amides, polyhydric alcohol esters of fatty acids, paraffin, carnauba wax, natural waxes, synthetic waxes, petroleum waxes, mineral waxes, and fluoro-containing materials wherein said film forming binder may be selected from the group consisting of polyurethanes, cellulose acetates, poly (methyl methacrylate), polyesters, polyamides, polycarbonates, polyvinyl acetate, proteins, protein derivatives, cellulose derivatives, polysaccharides, poly (vinyl lactams), acrylamide polymers, poly(vinyl alcohol), derivatives of poly(vinyl alcohol), hydrolyzed polyvinyl acetates, polymers of methacrylates, polymers of alkyl acrylates, polymers of sulfoalkyl acrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, copolymers containing styrene sulfonic acid, gelatin and combination thereof wherein said filler particles may be selected from the group consisting of matte beads, silica, glass beads, pigments, and polymeric beads such as methacrylate beads. The upper shield layer of the invention may be applied from either aqueous or solvent coating compositions. By using a tough binder as part of the upper protective shield, there is improved resistance to abrasions and scratches because more force is required create a problem. The polymer may have a mean particle size of less than 500 nm and may be impregnated with a water-insoluble lubricant. The polymer particles are used to form a surface protective layer for viewing side of the imaging element and provide surface slip properties and resistance to physical and mechanical scratch and abrasion. Materials like silicates may also be used in a protective shield. Silicates are hard particles and, when used in combination with tough binder and lubricates, add additional protection by lowering the surface area of the shield layer, which further improves the sliding friction of the imaging element. Preferred binders that may be used in the upper shield to minimize scratches and/or fingerprints are polyurethane, polycarbonates, epoxies, and/or gelatin because they form clear tough hard layers that resist yellowing, as well as abrasions. Additional materials that may be added to the preferred upper shield include wax esters of high fatty acids, carnauba wax, fluoro-containing containing materials, silicates, silica, and polymeric beads.

In an additional embodiment of said invention with a developed image, said upper shield provides said transparent polymer protection from fingerprinting. The upper shield may comprise silica, low levels of pigment, polymeric beads, glass beads, or other materials known in the art to provide a roughness frequency that hides the formation of the fingerprint. A typical range of roughness to minimize fingerprint show-through is between 0.10 to 0.65 micrometers at a spatial frequency of between 0.03 and 6.35 millimeters. Said upper shield may comprise a binder as described above or may additionally include a fluoro(meth) acrylate interpolymer having repeating units of A and B wherein A comprises a fluorine containing acrylate or methacrylate monomer and B comprises an ethylenically unsaturated monomer containing hydratable groups wherein said interpolymer comprises from 10 to 90 wt % of units A and from 10 to 90 weight % of units B. The interpolymer may further comprise ethylene, vinyl acetate, vinyl halide, vinylidene halide, acrylonitrile, methacrylonitrile, glycidyl acrylate, alkyl acrylates, alkyl methacrylates, glycidyl methacrylate, styrene, alkyl styrene, vinylpyridine groups, vinyl alkyl ether, vinyl alkyl ketone, butadiene, and vinyl silane. The interpolymers suitable have a molecular weight of from about 5,000 to about 10,000,000. The upper shield may further comprise cross-linking agents, transparent magnetic recording particles, abrasive particles, conductive polymers, conductive metal oxide particles, coating aids, charge control surfactants, fillers, lubricants, or matte beads. The upper shield must not effect the transparency, color, or other imaging properties of the photographic image. The application and curing of the upper shield must be compatible with the imaging element manufacturing process. The upper shield may provide fingerprint resistances when applied as a submicron-thick layer. Furthermore, the upper shield of the invention should not degrade the transparency, frictional characteristics, or other physical properties of the imaging element, and may be applied from solvent or aqueous media at low cost.

The upper shield coatings may further comprise a vinylic interpolymer having repeat units of A and B where A is derived from fluorine-containing acrylate or methacrylate monomers and B is derived from ethylenically unsaturated monomers containing hydratable groups.

The fluoro(meth)acrylate interpolymers may comprise 10 to 90 weight % of units A and 10 to 90 weight % of units B. Non-interfering amounts of monomers other than those described above can also be incorporated into the fluoro (meth)acrylate interpolymers of this invention. For example, the interpolymers may contain up to about 50 weight percent of polymer units derived from ethylene, vinyl acetate, vinyl halide, vinylidene halide, acrylonitrile, methacrylonitrile, alkyl acrylates and metacrylates, glycidyl acrylate, glycidyl methacrylate, styrene, alkyl styrenes, vinylpyridine, vinyl alkyl ethers, vinyl alkyl ketones, butadiene, vinyl silanes, and mixtures thereof.

Water soluble polymers may also be included in the upper shield. Typical examples include gelatin, polyvinyl alcohol, polyvinyl pyrrolidone, cellulosics, polystyrene sulfonic acid and its alkali metal salts or ammonium salts, water soluble (meth)acrylic interpolymers, and the like. Water dispersible polymers that may be used in conjunction with the fluoro (meth)acrylate interpolymer include latex interpolymers containing ethylenically unsaturated monomers such as acrylic and methacrylic acid and their esters, styrene and its derivatives, vinyl chloride, vinylidene chloride, butadiene, acrylamides and methacrylamides, and the like. Other water dispersible polymers that may be used include polyurethane and polyester dispersions. The amount of water soluble polymer should be limited. Preferably, the upper shield overcoat layer contains at least 70 weight % of the fluoro (meth)acrylate interpolymer.

The upper shield layer compositions may also contain suitable cross-linking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The cross-linking agents may react with the functional groups present on the fluoro(meth)acrylate interpolymer, and/or the other water soluble or water dispersible polymer present in the coating composition. By providing a cross-linked binder, the upper shield may provide superior abrasion resistances.

Matte particles well known in the art may also be used in the upper shield layer compositions of the invention, such matting agents have been described in *Research Disclosure*, December 1989, Item 308119, pages 1008–1009, published by Kenneth Mason Publications, Ltd., Dudley Annex, 12a North Street, Emsworth, Hampshire PO10 7DQ, ENGLAND. When polymer matte particles are employed, the polymer may contain reactive functional groups capable of forming covalent bonds with the fluoro(meth)acrylate interpolymer by intermolecular cross-linking or by reaction with a cross-linking agent in order to promote improved adhesion of the matte particles to the coated layers. Suitable reactive functional groups include hydroxyl, carboxyl, carbodiimides, epoxide, aziridine, vinyl sulfone, sulfinic acid, active methylene, amino, amide, allyl, and the like. The upper shield layer can contain other additives such as magnetic recording particles, abrasive particles, conductive polymers, conductive metal oxide particles, coating aids, charge control surfactants, and lubricants. The upper shield composition of the present invention may also include lubricants or combinations of lubricants to reduce sliding friction of the image elements in accordance with the invention. Typical lubricants include (1) silicone based materials disclosed, for example, in U.S. Pat. Nos. 3,489,567; 3,080,317; 3,042,522; 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, such as disclosed in U.S. Pat. Nos. 2,454,043; 2,732,305; 2,976,148; 3,206,311; 3,933,516; 2,588,765; 3,121,060; 3,502,473; 3,042,222, and 4,427,964, in British Patent Nos. 1,263,722; 1,198,387; 1,430,997; 1,466,304; 1,320,757; 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly (trifluorochloroethylene), poly(vinylidene fluoride, poly (trifluorochloroethylene-co-vinyl chloride), poly(meth) acrylates, poly(itaconates), or poly(meth)acrylamides containing perfluoroalkyl side groups, and the like. Lubricants useful in the present invention are described in further detail in Research Disclosure Item. 308119, published December 1989, page 1006.

Useful lubricants include, for example, perfluorinated olefinic polymers, natural and synthetic waxes, silicone fluids, stearamides, oleamides, stearic acid, lauric acid, ethylene glycol distearate, ethylene glycol monostearate, and the like. Other lubricants include a material sold by 3M Company under the federally registered trademark FLUORAD, a material sold by DuPont de Nemours under the federally registered trademark TEFLON AF. An anti-abrasion layer of a fluorinated polymer may be applied to the transparent polymer sheet. The anti-abrasion layer is derivative of polytetrafluoroethylene (PTFE), which is sold under the federally registered trademark TEFLON AF and marketed by DuPont de Nemours.

While other silanes may be employed, a preferred silane is a preparation of 0. 125% by weight of N-2-amino ethyl)-3-aminopropyltrimethoxysilane in isopropyl alcohol (2 propanol). A preferred fluorocarbon for the lubricating layer is a material sold by 3M Company under the federally registered trademark FLUORAD, and is most preferably FLUORAD FC-722. This material is sold diluted to a 2% solution in a fluorinated solvent. The FLUORAD FC-722 layer is not susceptible to attack by fingerprint oils. Moreover, the resulting topcoat has a low visibility of fingerprints and the like. That is, the topcoat has a high contact angle that exhibits anti-smudge characteristics. The lubricating layer imparts a low surface energy of less than 40 dynes/cm, and preferably exhibits a surface energy of less than 20 dynes/cm. An alternative fluorocarbon is the tetrafluoroethylene derivative or copolymer sold by DuPont under the federally registered trademark TEFLON AF.

Other additional compounds that can be employed in the upper shield compositions of the invention include surfactants, coating aids, coalescing aids, inorganic fillers such as non-conductive metal oxide particles, magnetic particles, pigments, dyes, biocides, UV and thermal stabilizers, and other addenda well known in the imaging art.

One means of providing a shield that is resistant to scratches is to apply an overlaminated transparent polymer sheet to the surface of the transparent polymer sheet of this invention. In this embodiment any suitable polymer sheet may be used such as polyester, polyolefin, polycarbonate, or polyamide. In the most preferred embodiment the sheet comprises polycarbonate which may be further provided with a textured surface. Polycarbonate is highly desirable because it is a tough polymer sheet and offers superior scratch resistance. The scratch resistant polymer sheet has a scratch resistance of greater than 3 grams. The scratch data was determined by applying a 1500 g ramped load force at a velocity of 10 mm/min. with a 54 $\mu$m radius, 120 degree conical Rockwell Diamond stylus. The scratch length was 10 mm. The samples were then examined visually for the presence of a scratch. This is preferred because it offers a wide range in scratch resistance and improved durability of prior practices. Other polymers and additives that may be added to the upper surface of the overlaminate to enhance their scratch resistances include polyurethanes, polyesters, epoxies, and other polymers disclosed above. Various hard filler particles may be used in these polymers such as pigments, silica, silicates, and glass beads. The use of texture with a roughness average of 50 to 250 is also useful in minimizing fingerprinting. Texture may also be enhanced by combination with filler particles.

Conductive layers are useful to minimize static discharge during winding and conveyance of the imaging member. To overcome the problem of accumulation of static charges it is conventional practice to provide an antistatic layer (i.e., an electrically-conductive layer) in photographic elements. A very wide variety of antistatic layers are known for use in photographic elements. For example, an antistatic layer comprising an alkali metal salt of a copolymer of styrene and styrylundecanoic acid is disclosed in U.S. Pat. No. 3,033,679. Photographic films having a metal halide, such as sodium chloride or potassium chloride, as the conducting material, in a hardened polyvinyl alcohol binder are described in U.S. Pat. No. 3,437,484. In U.S. Pat. No. 3,525,621 the antistatic layer is comprised of colloidal silica and an organic antistatic agent, such as an alkali metal salt of an alkylaryl polyether sulfonate, an alkali metal salt of an arylsulfonic acid, or an alkali metal salt of a polymeric carboxylic acid. An antistatic layer comprised of an anionic film forming polyelectrolyte, colloidal silica, and a polyalkylene oxide is disclosed in U.S. Pat. No. 3,630,740. In U.S. Pat. No. 3,681,070 an antistatic layer is described in which the antistatic agent is a copolymer of styrene and styrene sulfonic acid. U.S. Pat. No. 4,542,095 describes antistatic compositions comprising a binder, a nonionic surface-active polymer having polymerized alkylene oxide monomers, and an alkali metal salt. In U.S. Pat. No. 4,916,011 an antistatic layer comprising a styrene sulfonate-maleic acid copolymer, a latex binder, and an alkyl-substituted trifunctional aziridine cross-linking agent is disclosed. An antistatic layer comprising a vanadium pentoxide colliodal gel is described in U.S. Pat. No. 4,203,769. U.S. Pat. Nos. 4,237,194; 4,308,332; and 4,526,706 describe antistats based on polyaniline salt-containing layers. Cross-linked vinylbenzyl quaternary ammonium polymer antistatic layers are described in U.S. Pat. No. 4,070,189. One problem with antistats in a light sensitive application is that the chemicals in a photographic processing solution are capable of reacting with or solubilizing the conductive compounds in an antistatic layer, thus causing a diminution or complete loss of the desired antistatic properties. To overcome this problem, antistatic layers may be located below an upper protective shield layer to chemically isolate the antistatic layer, as well as to provide scratch and abrasion resistances and additional fingerprint protection, or the antistatic properties may be added directly to the scratch and abrasion resistances shield layer. The antistat may also be on the same side as but above the image layer. In this case the transparent polymer sheet may comprise a bottom layer that further comprises antistatic properties. This may be as a coated layer or may be integral to the polymer sheet itself. Typically, the protective shield layer may comprise a glassy polymer with a glass transition temperature (Tg) of 70° C. or higher that is applied from organic solvent-based or aqueous coating solutions. To apply the protective shield layer, the glassy polymers are normally dissolved in a solvent at very low solids to ensure low coating solution viscosities for good coatability at high coating speeds. Coating techniques employed include one to three layer extrusion dies (commonly referred to as X-hoppers), air knife, roller coating devices, meyer rods, and knife over roll.

One embodiment of this invention comprising a transparent polymer sheet, at least one layer of negative working emulsion and at least one upper protective shield that protects the transparent polymer sheet from scratches and abrasions further protects the transparent polymer sheet from electrostatic charge accumulation. In an additional embodiment the negative working emulsion has been imaged and developed. Said upper shields comprises electrostatic charge control materials selected from the group consisting of conductive particles including doped-metal oxides, metal oxides containing oxygen deficiencies, metal antimonates, conductive nitrides, carbides, or borides, for example, $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC. Also included are ionically-conductive sols such as colloidal $SiO_2$, $SnO_2$, $TiO_2$ and others. The photographic element of this invention preferably has an upper shield layer that has a surface resistivity of less than $10^{13}$ ohms per square. In the photographic industry, the need to provide photographic film and paper with antistatic protection has long been recognized. Such protection is important since the accumulation of static charges as a result of various factors in the manufacture, finishing, and use of photographic elements is a serious problem in the photographic art. Accumulation of static charges can result in fog patterns in photographic emulsions, various coating imperfections such as mottle patterns and repellency spots, dirt and dust attraction which may result in the formation of "pinholes" in processed films, and a variety of handling and conveyance problems. The most preferred embodiment of said upper shields comprises electrostatic charge control materials selected from the group consisting of tin oxide and vanadium pentoxide. The conventional art of antistats for photographic reflection prints is that they are always on the opposite side of the viewing side or below the image. A distinction of the invention is that the antistat layer is not only above the image and, therefore, must be optical clear for viewing and exposure, but may also be additionally functionalized or isolated to minimize scratches and to reduce fingerprints. Being above the image may include above the image on the same side and or above the image on the viewing or topside of the clear transparent sheet. This may be achieved in either a single layer or a plurality of layers with separate or synergistic functionality.

In the embodiments of this invention, the emulsion layer of the final assembled print is protected because it is covered on the bottom side by a white reflective substrate, and on the top or viewing side it is protected with a transparent polymer sheet that further comprises an upper protective shield to reduce scratching, fingerprinting and static buildup, and discharge. Scratch resistance may be provided by the use of particles and tough binders, as well as providing layers with low coefficient of friction. The upper shield of this embodiment further comprises lubricants, silicates, and a binder of polyurethane and/or polycarbonates. The water insoluble lubricant may be selected from the group consisting of silicone based materials, fatty acids, fatty acid derivatives, alcohols, alcohol derivatives, fatty acid esters, fatty acid amides, polyhydric alcohol esters of fatty acids, paraffin, carnauba wax, natural waxes, synthetic waxes, petroleum waxes, mineral waxes, and fluoro-containing materials as described above. By providing layers with lubricants, there is less resistance to sliding which helps to minimize scratches and abrasions.

Good surface lubricity can be obtained by coating the upper shield of the present invention at a coverage of greater than 5 $mg/m^2$. In principle, the upper value of the polymer particle coverage is limited actually by physical appearances of the surface rather than by the friction values of the layer. For example, if the coverage is too high, a hazy-looking surface will appear which, therefore, can have an effect on the sensitometric properties of the imaging element or interfere with the viewing of the print. The lower limiting value is set by the requirement on the surface friction value of the lubricant layer, which is determined by both manufacturing processes and applications of the imaging element.

When trying to build multiple functionality into a photographic element, it may be necessary to have more than one functional layer. In a preferred embodiment of this invention, said photographic element comprises a transparent polymer sheet, at least one layer containing negative working silver halide, and more than one functional layer on the upper surface of said transparent polymer sheet. Said above embodiment may also comprise a developed image. Having more than one layer is important in that it allows the layers to be designed more simply and specifically to provide the maximum functionality. In the case of fingerprint protection, having this functionality at the outer uppermost surface is important because it is this surface that is being touched during viewing.

The transparent polymer sheet of this invention may comprise polyolefin polymer. Polyolefin is preferred because it is relatively inexpensive, and in the most preferred case it is oriented. Orientation increases the mechanical modulus that is desirable in adding stiffness to the photographic element. In an additional embodiment said transparent polymer sheet comprises oriented polyester. Polyester is preferred because it is a tougher polymer and has a higher modulus adding strength properties beyond that of olefins. In an additional embodiment of this invention the transparent sheet has a thickness of between 6 and 100 micrometers. Thin transparent polymer sheets in the 6 to 45 micrometer range are preferred because they are light in weight, generally cheaper, and more footage can be wound onto a roll. Thinner sheets are preferred because they conform better and are easier to adhere to white reflective backings. On the other hand, thicker webs above 50 micrometers are easier to convey through photoprocessing equipment. Thicker webs are also less prone to curl problems during lamination.

In the formation of a photographic element there is an adhesion promoting layer between said transparent polymer sheet and at least one layer containing silver halide. Said adhesion promoting layer may comprise polyethylene or copolymer of ethylene. The polymer base preferably is provided with an integral emulsion adhesion layer to avoid the need for expensive primer and sub coatings known in the art to improve gelatin adhesion to polymer sheets. An example of a suitable integral emulsion adhesion layer is described in U.S. Pat. No. 5,866,282 (Bourdelais et al). The most preferred integral emulsion adhesion layer is a layer of polyethylene that is corona discharge treated (CDT) treated prior to the coating of light sensitive silver halide imaging layers. Polyethylene is preferred because it has great adhesion characteristics to gelatin and is a relatively inexpensive polymer. The transparent sheet may have coatings applied to either or both sides on the transparent sheet if needed. If one or both surface layers of the transparent support sheet comprises polyethylene, then there is less need for the silver halide adhesion layer. Subbing layers used to promote adhesion of coating compositions to the support are well known in the art and any such material can be employed. Some useful compositions for this purpose include interpolymers of vinylidene chloride such as vinylidene chloride/methyl acrylate/itaconic acid terpolymers or vinylidene chloride/acrylonitrile/acrylic acid terpolymers, and the like. These and other suitable compositions are described, for example, in U.S. Pat. Nos. 2,627,088; 2,698,240; 2,943,937; 3,143,421; 3,201,249; 3,271,178; 3,443,950; and 3,501,301. The polymeric subbing layer is usually overcoated with a second subbing layer comprised of gelatin or a combination of gelatin and a latex polymer, typically referred to as gel sub.

In this invention the photographic element comprising a transparent polymer sheet, at least one layer containing an image formed by development of a negative working photosensitive silver halide and at least one upper protective shield to protect the surface of said transparent polymer is adhesively adhered to a base. Said base material may be clear, translucent, or white opaque reflecting. It may comprise paper, cellulose, polymer sheet, cloth, or other substrate materials. In this invention, an upper shield protects the transparent polymer from fingerprints, static, and abrasion.

To adhere the transparent sheet with the developed image layers to the base, a bonding layer is required. The bonding layer must provide excellent adhesion between the imaging layers and the base for the useful life of the image. The preferred method of adhering the imaging layers and base is by use of an adhesive. The adhesive preferably is coated or applied to the base. The adhesive preferably is a pressure sensitive or heat activated adhesive. During the bonding process, the imaging layers are adhered to the base material by use of a nip roller or a heated nip roll in the case of a heat-activated adhesive. A preferred pressure sensitive adhesive is an acrylic-based adhesive. Acrylic adhesives have been shown to provide an excellent bond between gelatin developed imaging layers and biaxially oriented polymer base sheets.

The preferred thickness of the adhesive layer is between 2 and 40 micrometers. Below 1 micrometer, uniformity of the adhesive is difficult to maintain leading to undesirable coating skips. Above 45 micrometers, little improvement in adhesion and coating quality is observed and, therefore, increased adhesive is not cost justified. An important property of the adhesion layer between the imaging layers and base is the optical transmission of the adhesive layer. A laminated adhesive layer with an optical transmission greater than 90% is preferred, as the adhesive should not interfere with the quality of the image. Furthermore, the adhesive should not yellow over time or with exposure to varying environmental conditions.

In the embodiment of this invention wherein the exposed and developed image is laminated adjacent to a white reflective base and there is a clear transparent polymer sheet over the image, there remains a need for a coatable or integral layer within the transparent polymer sheet to protect the polymer sheet from fingerprints, scratches, and abrasion. Such a coatable or integral layer will provide an upper shield to protect the print. Since this layer is not in direct contact with the image and does not have to adhere to gelatin, a wider variety of materials may be used. While such materials need to be compatible with photoprocessing, they can be applied in a factory environment and are more manageable than post processing application in a photofinisher.

Other materials that may be used in the upper shield are a combination of two colloidal dispersions of water insoluble hydrophobic polymeric materials and wax particles. At least one of the polymeric materials has glass transition temperature equal to or higher than 25° C. to provide toughness and non-tacky surface properties. The second polymeric material has glass transition temperature below 25° C. in order to form a continuous film layer at the mild drying condition. The weight ratio of the two polymeric materials is from 3:97 to 80:20 by weight. The average particle size of colloidal dispersions of polymeric materials is from 5 micrometers to 500 micrometers. The types of wax particles include dispersions of submicron size, from 0.01 micrometer to 0.5 micrometer wax particles such as offered commercially as aqueous dispersions of polyolefins, polypropylene, polyethylene, high density polyethylene, oxidized polyethylene, ethylene acrylic acid copolymers, microcrystalline wax, paraffin, and natural waxes. The preferred particle size for the wax particles is between 0.01 micrometer and 0.2 micrometer. The preferred amount used in the formulation is 1% to 30% by weight based on the total dry laydown of the protective overcoat formulation. The preferred melting temperature for the wax particles is higher than 60° C. The protective layer formulation with the wax particles has lower friction coefficient, improved scratch resistance, and lower propensity of blocking (prints adhering face to face) in high temperature environment. The dry laydown of the total materials on the surface of photographic product is from 0.3 $g/m^2$ to 6 $g/m^2$. The colloidal dispersions of hydrophobic polymers used for the first or second polymeric particle are generally latexes or hydrophobic polymers of any composition that can be stabilized in a water-based medium. Such hydrophobic polymers are generally classified as either condensation polymers or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl esters, vinyl heterocyclic compounds, styrenes, olefins and halogenated olefins, unsaturated acids and esters derived from them, unsaturated nitrites, vinyl alcohols, acrylamides and methacrylamides, vinyl ketones, multifunctional monomers, or copolymers formed from various combinations of these monomers. Such latex polymers can be prepared in aqueous media using well-known free-radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. The aqueous phase of the latex or colloidal dispersion of the invention may contain water-soluble polymers in order to control, for example, the viscosity and flow characteristics. The aqueous phase may also include surfactants of the cationic, anionic, zwitterionic or non-ionic types. Further listings of suitable monomers for addition type polymers are found in U.S. Pat. No. 5,594,047.

In the most preferred embodiment, this invention comprises a photographic element further comprising at least one layer containing an image formed by development of a negative working photosensitive silver halide and at least one protective upper shield on a transparent polymer where said upper shield comprises a transparent cross-linked polymer comprising matte particles and lubricants. Furthermore, said upper shield protects said transparent polymer sheet from scratches and/or from electrostatic charge. Said upper shield may comprise a variety of polymers, lubricants, and particles to enhance scratch protection. Said upper shield may comprise polyurethanes, polyester, acrylic, vinyl, polyamides, polyureas, polyethers, polycarbonates, and other polymer described above or other polymers known in the art. In the most preferred embodiment, said the upper shield compositions comprise polyurethane dispersed in an organic solvent medium. The coating compositions are prepared by dispersing an aqueous dispersible polyurethane into a water miscible organic solvent or solvent mixture. Conventional organic solvent-based polyurethane coating compositions utilize solvent soluble polyurethanes that are very viscous and require the use of solvents such as tetrahydrofuran, dimethylformamide, and toluene to dissolve the polyurethane. Such solvents are undesirable due to environmental or health concerns or incompatibility with imaging element manufacturing processes and solvent recovery operations. Said polyurethane coating may have an organic solvent-based coating compositions that have low viscosities at high % solids and give dried layers with excellent physical and mechanical properties. In addition, the coating compositions may utilize more desirable solvents such as acetone, methanol, ethanol, and propanol. The upper shield compositions of the present invention may contain mixtures of the dispersed polyurethane with the solvent dispersible core-shell polymers described in U.S. Pat. Nos. 5,597,680; 5,597,681; and 5,695,919. The coating composition of the present invention can also contain up to about 70 weight %, preferably up to about 50 weight % of solution polymers. The solution polymers are defined as those that are soluble in the desired solvent medium; these include acrylic polymers, cellulose esters, cellulose nitrate, and others.

In a preferred embodiment of the photographic element comprising a transparent polymer sheet, at least one layer with a developed image and an upper shield that protects the transparent polymer sheet and is adhesively adhered thereto a base material, said upper shield has a scratch resistance of greater than 3 grams. Said photographic element's transparent polymer sheet may comprise any suitable polymer sheet such as polyester, polyolefin, polycarbonate, or polyamide. In the one preferred embodiment, the sheet comprises oriented polyolefin. Oriented polyolefin sheets are preferred because they readily available, inexpensive, and may be further functionalized. In another preferred embodiment said transparent polymer sheet comprises oriented polyester polymer. Oriented polyesters provide excellent optical clarity and are tough. Said preferred transparent polymer sheets may be further provided with a textured surface. The upper protective shield may also comprise more than one functional layer. In this embodiment the antistat may be applied directly to said transparent polymer sheet, and a second or third layer may be applied to provide scratch resistance and/or fingerprint resistance. Said transparent polymer sheet may have a thickness of between 6 and 100 micrometers. Thin transparent polymer sheets have an advantage of being lightweight that is important when print materials are being mailed. Furthermore, thin polymer sheets may be adhered to thicker base materials if stiffness is needed for the developed print. The thicker transparent sheets have an advantage of providing excellent stiffness when they are adhered to a very thin base material.

The photographic element of this invention when adhered to a base should be substantially opaque with a transmission of less than 15 percent. This provides sufficient opacity to prevent show through on the viewing side of the element. When adhering a transparent polymer sheet to a white reflective base, the upper surface whiteness may be at least L* of 93.5 and a b* of less than 2.0. Such a base provides a very white surface and has the appearance of a traditional photographic print.

In a further embodiment of this invention, a method of forming a two-sided image member comprising a photographic element comprising a transparent polymer sheet, at least one layer containing negative working photosensitive silver halide that has been developed and at least one upper protective shield to protect the surface of said transparent polymer wherein said photosensitive silver halide is exposed with a collimated beam of actinic radiation to form a plurality of images, developing said images, folding said images inwardly and adhesively adhering said two sided imaging member to a base, punching said member along at least one side to form a durable album page. This method is preferred because it provides a means of forming a composite image of several images that are formed into a member in which the images are not only protected by the transparent polymer sheet, but by functional layers that further resist handling of the image member. In an additional embodiment of the above imaging member, said image layer is an image receiving layer that has been imaged.

In a particularly preferred embodiment, the imaging elements of this invention are photographic elements, such as photographic display material, photographic papers, or photographic glass plates, in which the image-forming layer is a radiation-sensitive silver halide emulsion layer. Such emulsion layers typically comprise a film-forming hydrophilic colloid. The most commonly used of these is gelatin, and gelatin is a particularly preferred material for use in this invention. Useful gelatins include alkali-treated gelatin (cattle bone or hide gelatin), acid-treated gelatin (pigskin gelatin), and gelatin derivatives such as acetylated gelatin, phthalated gelatin, and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material, and at least one red-sensitive silver halide emulsion layer having associated therewith a cyan image dye-providing material. In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers, and the like. The base can be any suitable base as described in this invention. Typical bases include polymeric films, paper (including polymer-coated paper), glass, and the like. Details regarding base materials and other layers of the photographic elements of this invention are contained in *Research Disclosure*, Item 36544, September 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions, although other hydrophilic colloids can be used in accordance with usual practice. The preferred emulsions for the photographic element of the invention are silver chloride emulsions. Details regarding the silver halide emulsions are contained in *Research Disclosure*, Item 36544, September 1994, and the references listed therein. This invention may be utilized with any photographic emulsion as disclosed in U.S. Pat. Nos. 6,093,521; 5,866,282; or 6,080,532.

The photographic silver halide emulsions utilized in this invention can contain other addenda conventional in the photographic art. Useful addenda are described, for example, in *Research Disclosure*, Item 36544, September 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like. Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers, and redox dye-releasers, and the particular one employed will depend on the nature of the element and the type of image desired.

Dye-image-providing materials employed with conventional color materials designed for processing with separate solutions are preferably dye-forming couplers, i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples illustrate the practice of this invention. They are not intended to be exhaustive of all possible variations of the invention. Parts and percentages are by weight unless otherwise indicated.

EXAMPLES

Example 1

In this example a photographic element with an upper shield was constructed utilizing a thin transparent polyester sheet with an upper electrically conductive layer adjacent to the transparent polyester sheet, a layer of anti-scratch and fingerprint reduction layer overlaying the conductive layer. The viewing side is through the anti-scratch, conductive layers, as well as the thin transparent polymer sheet. A photographic emulsion is en the opposite and is farthest away from the viewer. After exposure and development, the image side of the photographic element is adhesively adhered to a base material that provides stiffness and handling properties, as well as creating an image that is protected on both sides from physical abuse. This example will show the significant improvement in image durability and image quality compared to standard photographic reflective paper. Further, because the paper base common to reflective print materials was added after the image was formed, the expense of manufacturing and developing images on a paper base was avoided.

The polyester sheet used in this example was a biaxially oriented, two side subbed by first applying a latex subbing terpolymer of acrylonitrile, vinylidene chloride, and acrylic acid to both sides of the support surface before drafting and tentering so that the final coating weight was about 92 mg/m$^2$. The subbing layer was dried at 95° C. An anti stat formula was coated on one side of the subbed, polyester support to give a total dry coating weight of about 1 mg/m$^2$. The antistat formula consisted of the following components prepared at 0.091% total solids:

| Material | % Solids | Wt. % |
|---|---|---|
| Terpolymer Latex* | 30 | 0.098 |
| Triton X-100 (Rohm and Haas) | 10 | 0.212 |
| Vanadium Pentoxide Dispersion | 5 | 0.6 |
| Demineralized Water | 5 | Balance |

*Terpolymer manufactured by Eastman Kodak (described under subbing)

The anti stat coating was coated with a protective layer to give a dry coating weight of about 1000 mg/m$^2$. The protective overcoat layer consisted of a polyurethane dispersion and lubricant:

| Material | % Solids | Wt. % |
|---|---|---|
| Polyurethane Dispersion (Witcobond W232 by Witco Chem.) | 30 | 11.2 |
| Michemlube 160 | 10 | 0.18 |
| Acetone | | 32 |
| Methanol | | 46.7 |
| Water | | 10 |

The protective overcoat was clear, smooth and provided the antistat layer with both resistance to abrasion and a chemical barrier to processing solutions. The Taber abrasion percent haze value (using ASTM D1044) for the protective overcoat abraded with a CS10F wheel at a 125 gram load for 100 cycles was 12.5%, which represents very good abrasion protection. The internal electrical resistivity (measured using the salt bridge method, described in R. A. Elder, "Resistivity Measurements on Buried Conductive Layers", EOS/ESD Symposium Proceedings, September 1990, pages 251–254.) of the support structure was about 7.8 log ohm/square and remained unchanged after processing the support in a standard EP-4 Color Print process. The coefficient of friction for the protective overcoat was 0.15 (the coefficient of friction was determined using the methods set forth in ANSI IT 9.4-1992) which is desirable for most photographic film backing applications. A photographic emulsion was coated on the primed and subbed side of the clear polyester sheet. The emulsion was prepared and coated as per U.S. Pat. No. 6,093,521. After the image was processed and developed, the clear transparent film sheet with antistat and overprotective layer was adhesively adhered to a white reflective polyethylene coated paper base. The paper base was a white extrusion grade pigmented polyethylene (density 0.917) coated paper base. The polyethylene was coated at 17 g/m$^2$ and was tinted to a b* of −2.1 and an optical brightener (Hostalux KS) was added at 0.15%. The pigment was anatase $TiO_2$ (Kronos 1014) and was present at 8% by weight of the polymer. On the backside of the paper base was a manufacturing logo printed by a gravure coater and a 24 g/m$^2$ layer of matte textured clear high density (0.931 g/cc) extrusion coating grade of polyethylene. A pressure polyester adhesive was coated on the white pigmented side. The adhesive coated base was brought into contact with the image on the transparent polymer sheet in a roller nip and pressure applied to adhere the two webs together.

Example 2

Same as Example 1 except the polyethylene coated base was replaced with an extrusion laminated base using a 10 melt index polyethylene coated at 12 g/m$^2$ and a layer of clear biaxially oriented polyolefin sheet of 1.2 mils thickness on each side of the base.

Example 3

Same as Example 1 expect the imaged transparent polymer base was adhered to a clear 1.0 mil polyester base that had been previously coated with a pressure sensitive adhesive.

Example 4

Same as example 1 expect multiple images were developed on two transparent bases with protective shields facing outward. A thick white reflective non-photographic paper base (230 g/m$^2$) with a thin 7 g/m$^2$ clear polyethylene (density 0.917 g/cc and a melt index of 13) on both sides was adhesive coated with a pressure sensitive acrylic (0.1 g/m$^2$) adhesive. The imaged side of the transparent bases was brought into contact under pressure to the adhesive on each side of the white reflective paper base. The two-sided composite imaged element was then punched along one side to form an album page.

Example 5

This example was similar to Example 4 but instead of using two separate transparent polymer bases that had been previously imaged, a single sheet of transparent polymer bases is imaged with a variety of images, developed, and then folded inwardly with the images next to an adhesive and white reflecting base.

Example 6

The polyester sheet used in this example was a biaxially oriented, two side subbed by first applying a latex subbing terpolymer of acrylonitrile, vinylidene chloride and acrylic acid to both sides of the support surface before drafting and tentering so that the final coating weight was about 92 mg/m$^2$. The subbing layer was dried at 100° C. An upper shield was coated to the sub layer side of the transparent polymer sheet. The materials were prepared as per Examples 1 and 3 of U.S. Pat. No. 5,876,910. The only change was the addition of matte silica (Syloid 72) at 50 mg/m$^2$ to the uppermost layer of the shield.

Example 7

This example was prepared in the similar manner to Example 5 except a dispersion of methyl methacrylate polymer beads was added and coated at approximately 75 mg/m$^2$.

Control:

The control sample used in this invention consisted of an imaged and developed photographic layer on top of a standard resin coated photographic paper. In this sample the image is facing outward towards the viewer. The photographic bases in Table 1 were prepared by melt extrusion using 1924P Low Density Polyethylene (Eastman Chemical Co.) (an extrusion grade low density polyethylene with a density of 0.917 g/cm$^3$ and a melt index of 4.2). The face or top side resin layer also contained 12.5% by weight of Rutile $TiO_2$ (DuPont 104) and was melt extruded and coated on a cellulose paper base at 24 g/m$^2$ coverage. A 24 g/m$^2$ layer of matte textured clear high density (0.931 g/cc) extrusion coating grade of polyethylene was applied to the backside. The backside was coated with an antistat containing a sodium salt of colloidal silica. This sample was emulsion coated using a standard color silver halide system as disclosed in U.S. Pat. No. 6,093,521.

TABLE 1

| Sample | Abrasion Resistance | Fingerprint Resistance | Surface Resistivity |
|---|---|---|---|
| Control | 2 | 2 | 3 |
| 1 | 4 | 4 | 5 |
| 2 | 4 | 4 | 5 |
| 3 | 4 | 4 | 5 |
| 4 | 4 | 4 | 5 |
| 5 | 4 | 4 | 5 |
| 6 | 5 | 5 | 5 |
| 7 | 5 | 5 | 5 |

Abrasion resistances, fingerprint resistances, and surface resistivity were all rated on a 1–5 level scale with 1=Poor, 2=Fair, 3=Good, 4=very good, and 5=excellent. The abrasion resistance was determined by using Taber abrasion and stylus scratching. Fingerprint resistance was determined by having forming a Dmax (black) background and having 8 different people handle a set of prints in a sequenced mammer. That is, person number 1 handled the prints in the following order: control, 1, 2, 3, 4, 5, 6, and then 7. The order was then changed by one with each person until person number 8 handled the prints in the following sequence: 7, 6, 5, 4, 3, 2, 1, and control. The prints were then examined under different viewing conditions and rated on a 1–5 scale (1 being poor or numerous fingerprints and 5 having little of no fingerprint visibility). While the samples were measured for electrical resistance as described above, they were qualitatively rated with less electrical resistance being rated higher in the 1–5 scale. As can be seem from the data in Table 1, the control was rated lower in performance for abrasion and fingerprint resistance and also had higher electrical resistance, making it more prone to static buildup. When matte particles and polymeric beads were added to samples 6 and 7, it is noted that there was an improvement in both abrasion and fingerprint resistances over the control, as well as samples 1–5.

The photographic emulsion used in these examples may be any of those known in the art. The photographic silver halide emulsion was a three-color system used typically in color print material and was processed using RA-4 chemistry for processing and development.

The invention has been described in detail with particular reference to certain preferred embodiments thereof, but it will be understood that variations and modifications can be effected within the spirit and scope of the invention.

What is claimed is:

1. A photographic element comprising a transparent polymer sheet, at least one layer containing an image formed by development of negative working photosensitive silver halide and at least one upper protective shield layer to protect the surface of said transparent polymer, and adhesively adhered to the lower side of said element a base material wherein said base is substantially opaque and has a transmission of less than 15 percent wherein said at least one upper protective shield provides protection from fingerprinting and spills of liquids and wherein said at least one upper shield layer has a roughness of between 0.10 and 0.65 micrometers at a spatial frequency of between 0.03 and 6.35 millimeters, with the provisio that antistatic layers are not present intermediate said transparent polymer sheet and said at least one upper protective shield layer.

2. The photographic element of claim 1 wherein at least one upper shield layer protects said transparent polymer from fingerprints.

3. The photographic element of claim 2 wherein said at least one upper shield layer comprises lubricants, film-forming polymeric binder and filler particles wherein said lubricant is selected from the group consisting of silicates, silicone based materials, fatty acids, fatty acid derivatives, alcohols, alcohol derivatives, fatty acid esters, fatty acid amides, polyhydric alcohol esters of fatty acids, paraffin, carnauba wax, natural waxes, synthetic waxes, petroleum waxes, mineral waxes, and fluoro-containing materials wherein said film forming binder is selected from the group consisting of polyurethanes, cellulose acetates, poly(methyl methacrylate), polyesters, polyamides, polycarbonates, polyvinyl acetate, proteins, protein derivatives, cellulose derivatives, polysaccharides, poly(vinyl lactams), acrylamide polymers, poly(vinyl alcohol), derivatives of poly (vinyl alcohol), hydrolyzed polyvinyl acetates, polymers of methacrylates, polymers of alkyl acrylates, polymers of sulfoalkyl acrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, copolymers containing styrene sulfonic acid, gelatin and combinations thereof and wherein said filler particles are selected from the group consisting of matte beads, silica, glass beads, pigments, and polymeric beads.

4. The photographic element of claim 2 wherein said at least one upper shield layer comprises wax esters of high fatty acids, silicates, carnauba wax, fluoro-containing materials, silica, polymeric beads, polyurethanes, polycarbonates and/or gelatin.

5. The photographic element of claim 1 wherein at least one upper shield layer protects said transparent polymer sheet from scratches.

6. The photographic element of claim 5 wherein said at least one upper shield layer comprises lubricants, film-forming polymeric binder and filler particles wherein said lubricant is selected from the group consisting of silicates, silicone based materials, fatty acids, fatty acid derivatives, alcohols, alcohol derivatives, fatty acid esters, fatty acid amides, polyhydric alcohol esters of fatty acids, paraffin, carnauba wax, natural waxes, synthetic waxes, petroleum waxes, mineral waxes, and fluoro-containing materials wherein said film forming binder is selected from the group consisting of polyurethanes, cellulose acetates, poly(methyl methacrylate), polyesters, polyamides, polycarbonates, polyvinyl acetate, proteins, protein derivatives, cellulose derivatives, polysaccharides, poly(vinyl lactams), acrylamide polymers, poly(vinyl alcohol), derivatives of poly (vinyl alcohol), hydrolyzed polyvinyl acetates, polymers of methacrylates, polymers of alkyl acrylates, polymers of sulfoalkyl acrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, copolymers containing styrene sulfonic acid, gelatin and combination thereof wherein said filler particles is selected from the group consisting of matte beads, silica, glass beads, pigments, and polymeric beads.

7. The photographic element of claim 5 wherein said upper shield layer comprises wax esters of high fatty acids, silicates, carnauba wax, fluoro-containing materials, silica, polymeric beads, polyurethanes, polycarbonates, or gelatin.

8. The photographic element of claim 5 wherein said at least one upper shield layer has scratch resistance of greater than 3 grams.

9. The photographic element of claim 1 wherein said at least one upper shield comprises more than one functional layer.

10. The photographic element of claim 1 wherein said transparent polymer sheet comprises oriented polyolefin polymer.

11. The photographic element of claim 1 wherein said transparent polymer sheet comprises oriented polyester polymer.

12. The photographic element of claim 1 wherein said transparent polymer sheet has a thickness between 6 and 100 micrometers.

13. The photographic element of claim 1 wherein said base is white and reflective and comprises an upper surface whiteness of at least an L* of 93.5 and a b* of less than 2.0.

14. The photographic element of claim 1 wherein said at least one upper protective shield layer comprises silica.

15. The photographic element of claim 1 wherein said at least one upper protective shield layer comprises pigment.

16. A method of forming a two-sided image member comprising providing an imaging element comprising a transparent polymer sheet, at least one layer containing image receiving layer and at least one upper protective shield to protect the surface of said transparent polymer wherein said image receiving layer forms a plurality of images, folding said images inwardly and adhesively adhering said two-sided imaging member to a base, punching said member along at least one side, with the proviso that antistatic layers are not present intermediate said transparent polymer sheet and said at least one upper protective shield layer, wherein said at least one upper protective shield layer comprises polymeric beads.

* * * * *